US010584919B2

(12) United States Patent
Trocano et al.

(10) Patent No.: US 10,584,919 B2
(45) Date of Patent: Mar. 10, 2020

(54) ROTARY DRUM FINISHING DRYER

(71) Applicant: ANDERSON INTERNATIONAL CORPORATION, Stow, OH (US)

(72) Inventors: Leonard Trocano, Akron, OH (US); Jacob Trocano, Akron, OH (US); Samuel D. Stone, Kirbyville, TX (US)

(73) Assignee: Anderson International Corporation, Stow, OH (US)

( * ) Notice: Subject to any disclaimer, the term of this patent is extended or adjusted under 35 U.S.C. 154(b) by 115 days.

(21) Appl. No.: 16/049,964

(22) Filed: Jul. 31, 2018

(65) Prior Publication Data

US 2019/0049180 A1 Feb. 14, 2019

Related U.S. Application Data

(60) Provisional application No. 62/544,378, filed on Aug. 11, 2017.

(51) Int. Cl.

| | |
|---|---|
| ***F26B 13/16*** | (2006.01) |
| ***F26B 11/04*** | (2006.01) |
| ***F26B 3/06*** | (2006.01) |
| ***F26B 11/02*** | (2006.01) |
| ***F26B 11/06*** | (2006.01) |

(52) U.S. Cl.

CPC ..... *F26B 13/16* (2013.01); *F26B 3/06* (2013.01); *F26B 11/028* (2013.01); *F26B 11/0477* (2013.01); *F26B 11/0486* (2013.01)

(58) Field of Classification Search

CPC ..... F26B 3/06; F23G 5/20; F23G 5/22; C10B 47/30; C10B 1/10; C10J 3/005; F23B 30/04

See application file for complete search history.

(56) References Cited

U.S. PATENT DOCUMENTS

| | | | | | |
|---|---|---|---|---|---|
| 1,571,703 | A | * | 2/1926 | Butzbach | F26B 11/028 34/132 |
| 3,222,797 | A | | 12/1965 | Zies | |
| 3,242,888 | A | * | 3/1966 | Klovers | F23J 1/00 110/246 |
| 3,408,969 | A | * | 11/1968 | Maurice | F23G 5/20 110/240 |
| 3,646,898 | A | * | 3/1972 | Bavers | F23G 5/20 110/246 |
| 3,918,893 | A | * | 11/1975 | Whitaker | F27B 7/20 432/103 |
| 3,981,658 | A | | 9/1976 | Briggs | |
| 4,447,966 | A | * | 5/1984 | Mollenkopf | F16C 13/04 34/108 |
| 4,901,635 | A | | 2/1990 | Williams | |
| 6,110,430 | A | * | 8/2000 | Swisher, Jr. | B09C 1/06 110/226 |

(Continued)

*Primary Examiner* — David J Laux

(74) *Attorney, Agent, or Firm* — Calfee, Halter & Griswold LLP

(57) ABSTRACT

A rotary drum dryer includes a shell, an apertured rotary drum disposed within the shell and positioned to define a plenum between an interior surface of the shell and an exterior surface of the rotary drum, the plenum being divided into a plurality of zones by at least one separator plate disposed in the shell, and a plurality of drying air inlet nozzles disposed along the shell, each of the plurality of drying air inlet nozzles being positioned to direct drying air into a corresponding one of the plurality of zones.

19 Claims, 4 Drawing Sheets

(56) References Cited

U.S. PATENT DOCUMENTS

| | | | | |
|---|---|---|---|---|
| 6,221,329 | B1 * | 4/2001 | Faulkner | B07B 4/06<br>423/445 R |
| 8,501,142 | B2 * | 8/2013 | Tennison | C08F 2/18<br>422/198 |

* cited by examiner

ROTARY DRUM FINISHING DRYER

CROSS-REFERENCE TO RELATED APPLICATION

This application claims priority to and all benefit of U.S. Provisional Patent Application Ser. No. 62/544,378, filed on Aug. 11, 2017, for ROTARY DRUM FINISHING DRYER, the entire disclosure of which is fully incorporated herein by reference.

TECHNICAL FIELD OF THE INVENTIONS

The present disclosure relates to rotary drum dryers, and more particularly, to rotary drum dryers for polymer crumb finish line drying operations.

BACKGROUND

In the production of polymers, such as synthetic rubber, the product obtained from the polymerization process is often in the form of an aqueous slurry. The water-slurried polymer must be dewatered and dried prior to packaging for use. Conventional mechanical dewatering equipment (e.g., Expeller® press, Expander/Dryer® mechanical dryer, both manufactured by Anderson International Corp.) typically reduce the water content of a polymerized material slurry from about 70%-90% to about 10%-20%, and subsequent processing in a conventional drying apparatus (e.g., Expander/Dryer® mechanical dryer) further reduces the water content of the polymer material to about 2%-4%. To remove a substantial amount of the remaining moisture content from the dewatered, dried polymer material (e.g., down to about 0.5% moisture), and to maintain the polymer material in a loose, crumb form, the polymer material is conventionally transported to baling or packaging equipment by a finishing line, including additional conventional drying equipment, such as one or more of an apron dryer, a fluid bed vibratory conveyor, and a spiral elevator conveyor. This finishing line equipment often has a large plant footprint (e.g., to provide sufficient final drying time), and is often costly to power and maintain.

SUMMARY OF THE DISCLOSURE

In an exemplary embodiment of the present application, a rotary drum dryer includes a shell, an apertured rotary drum disposed within the shell and positioned to define a plenum between an interior surface of the shell and an exterior surface of the rotary drum, the plenum being divided into a plurality of zones by at least one separator plate disposed in the shell, and a plurality of drying air inlet nozzles disposed along the shell, each of the plurality of drying air inlet nozzles being positioned to direct drying air into a corresponding one of the plurality of zones.

In an exemplary method of the present application, a crumb material is fed into an apertured rotary drum of a rotary drum dryer, and the rotary drum is rotated to axially advance the crumb material through the rotary drum dryer toward a discharge chute. Drying air is supplied a plurality of drying air inlet nozzles disposed along a shell of the rotary drum dryer and into a corresponding plurality of zones in a plenum disposed between an interior surface of the shell and an exterior surface of the rotary drum, the plurality of zones being separated from each other by at least one separator plate disposed in the shell.

These and other aspects and advantages of the inventions described herein will be readily appreciated and understood by those skilled in the art in view of the accompanying drawings.

BRIEF DESCRIPTION OF THE DRAWINGS

Further features and advantages of the inventions will become apparent from the following detailed description made with reference to the accompanying drawings, which are not necessarily (but may be) drawn to scale, wherein.

DESCRIPTION OF THE EXEMPLARY EMBODIMENTS

Although the exemplary embodiments herein are presented in the context of a rotary drum dryer for a finishing line of a polymer crumb processing system, the inventions herein are not limited to such applications, and will find use with many different drying and material processing applications.

In accordance with an exemplary aspect of the present application, a finishing line for crumb polymer materials is provided with a rotary drum dryer, which may be specifically configured for finishing drying of a polymer crumb material. The inventive rotary drum dryer arrangements of the present application may provide many advantages over a conventional finishing dryer system, including, for example, a smaller footprint, reduced power consumption, variable drying output, reduced equipment and maintenance costs, and easier cleaning.

Figure 1:
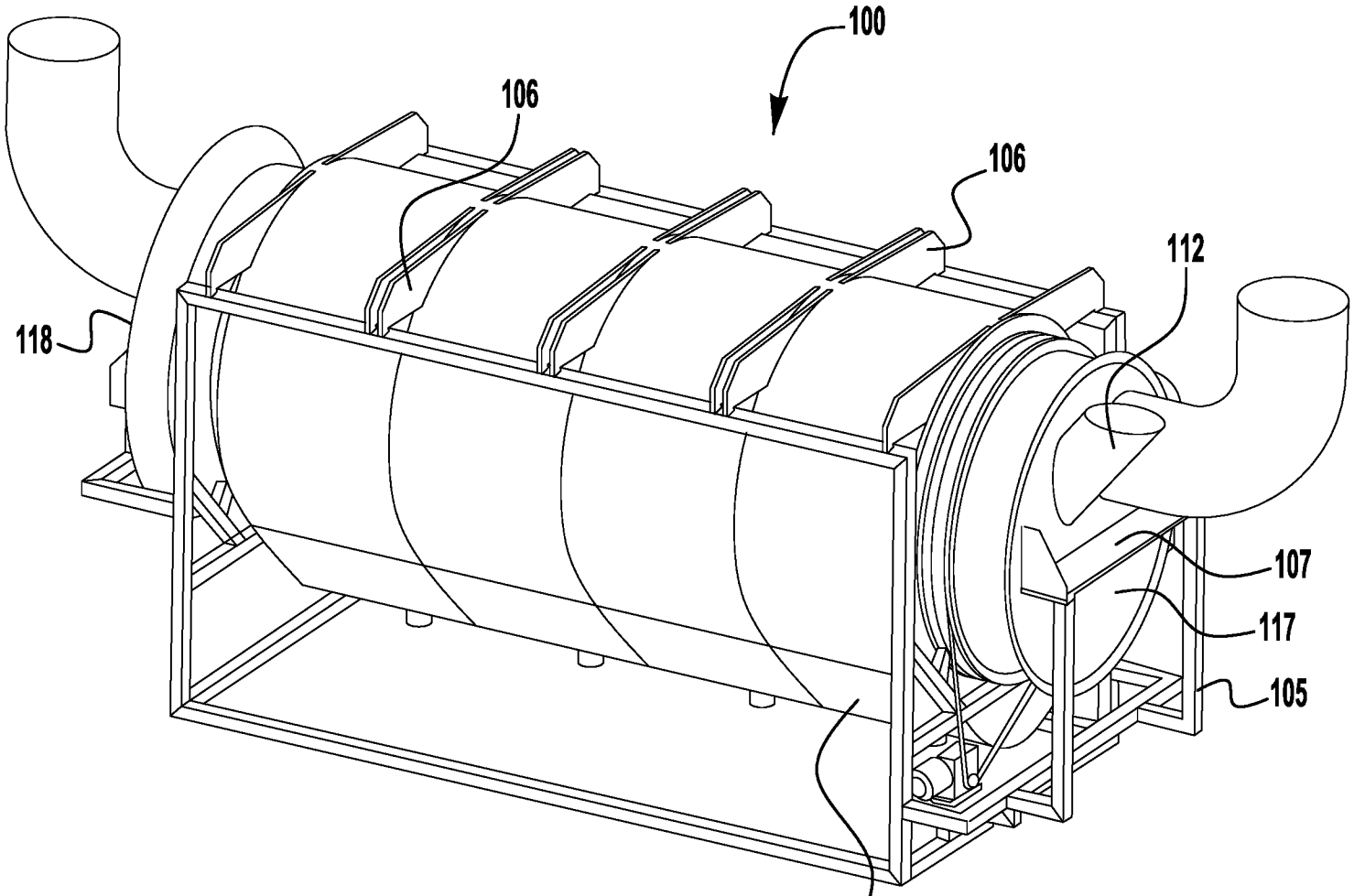
FIG. 1 is a side perspective view of a rotary drum dryer according to an exemplary embodiment of the present application.
Figure 2:
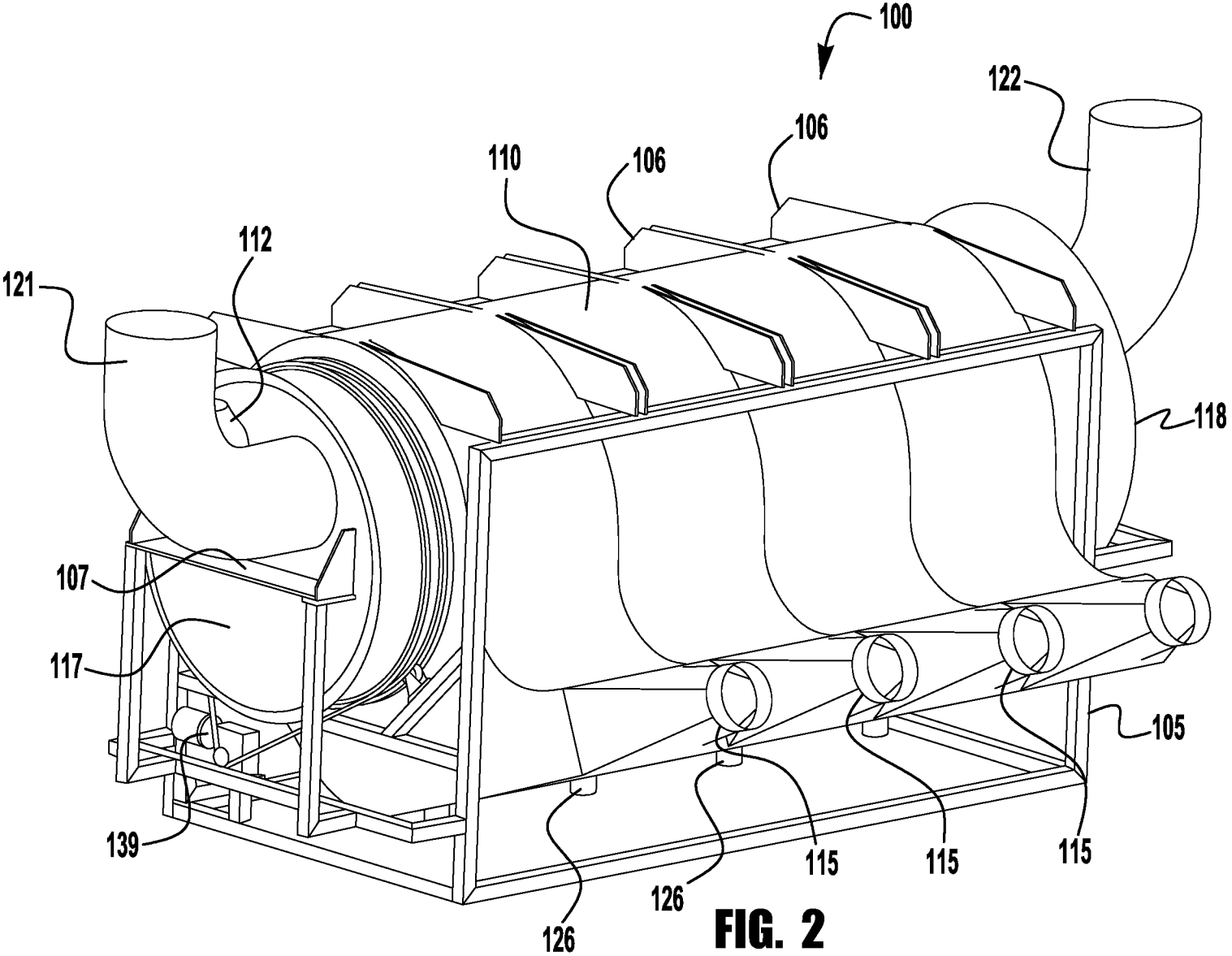
FIG. 2 is an opposite side perspective view of the rotary drum dryer of FIG. 1.
Figure 3:
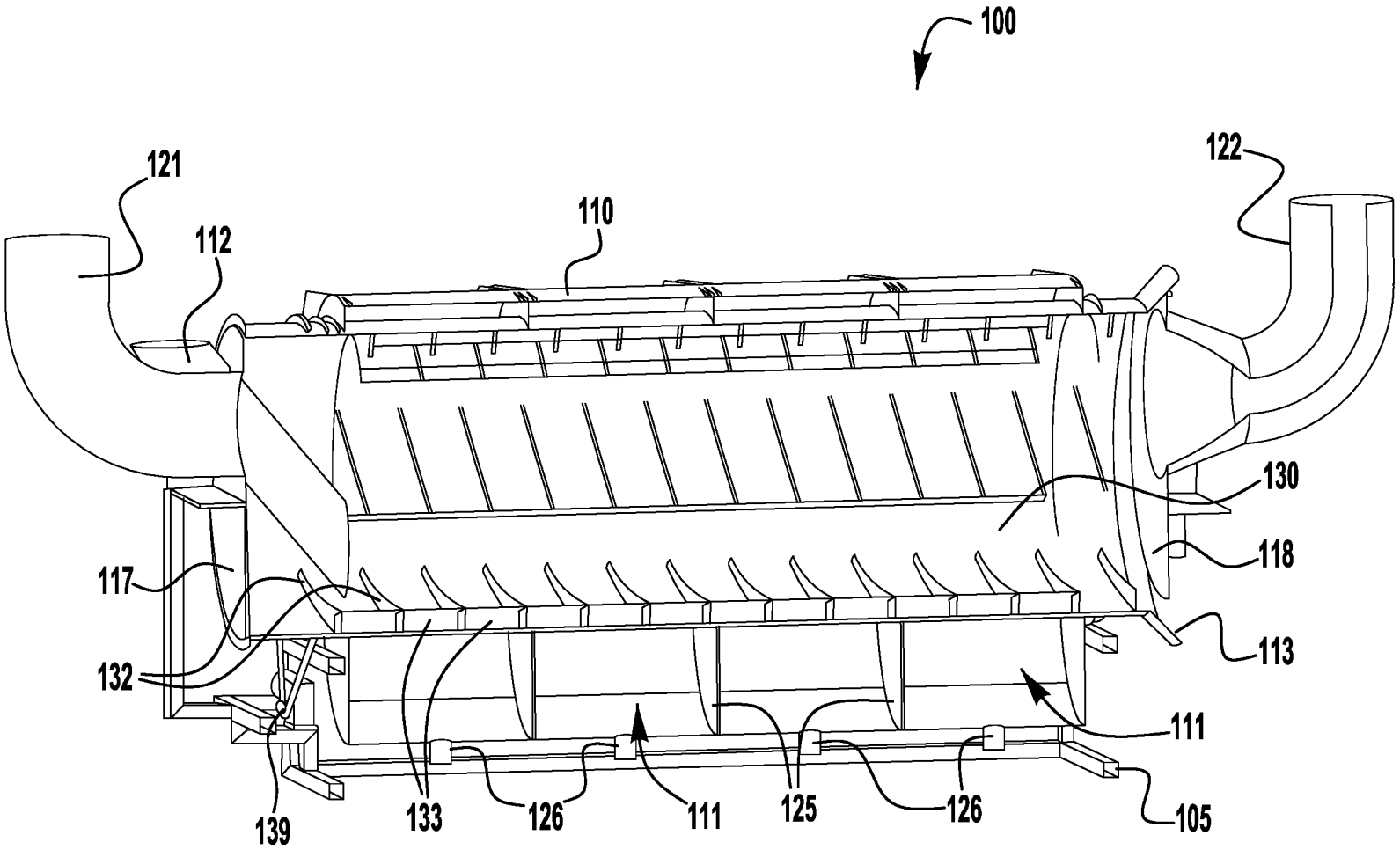
FIG. 3 is a side cross-sectional view of the rotary drum dryer of FIG. 1.
Figure 4:
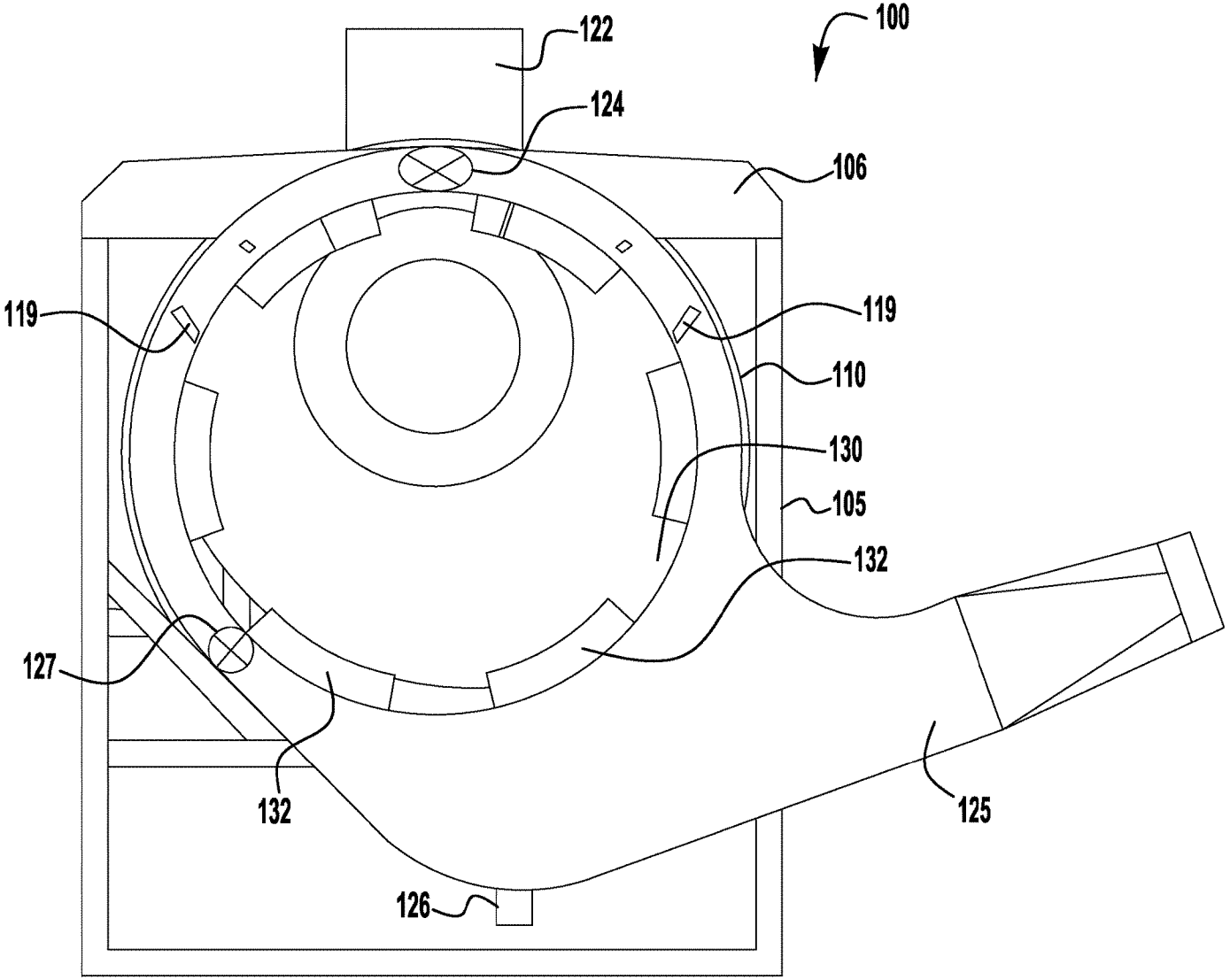
FIG. 4 is an end cross-sectional view of the rotary drum dryer of FIG. 1.

FIGS. 1-4 illustrate one such rotary drum dryer 100 contemplated for use in polymer crumb drying operations. The exemplary rotary drum dryer 100 includes an exterior shell 110 supported on a frame 105 (e.g., by cross plates 106 along the length of the shell, and/or by supports 107, 108 attached to the shell end caps 117, 118) and an interior rotary drum 130 disposed within the shell 110 to define a drying air plenum between the shell interior surface and the drum outer surface. The inlet end cap 117 includes a feed chute 112 through which the polymer crumb material is supplied, and the outlet end cap 118 includes a discharge chute 113 (FIG. 3) for outputting the dried polymer crumb material, for example, to a vibratory conveyor or crush/grinder (not shown) to prepare the material for baling and/or packaging. The shell may be insulated and externally sealed to help retain drying air, thereby eliminating escaping emissions and reducing operating costs.

To dry the polymer crumb material passing through the dryer, heated and/or conditioned drying air is supplied into the shell 110 through a series of ports or nozzles 115 (FIG. 2) along a lower portion of the shell, such that the drying air is supplied to the rotary drum 130 from beneath the drum. While any number of supply nozzles may be utilized, in the illustrated embodiment, four nozzles 115 are provided. Each port may be provided with an internal baffle or valve to allow for adjustment of inflow of the drying air at a controlled rate dependent on the production rate and the type of material being processed. Additionally, the different nozzles may be configured to supply drying air having different properties (e.g., temperature, pressure, flow velocity) as desired for the drying process of the crumb material passing from the inlet end to the outlet end of the dryer. In one embodiment, one or more of the nozzles at the inlet end (e.g., the first three nozzles) may be configured to provide hot air (e.g., 90°-120° C.), for example, for more effective drying, and one or more nozzles at the outlet end (e.g., the fourth and final nozzle) may be configured to provide cooler air (e.g., 0°–30° C.), for example, to cool off the polymer crumb material prior to its output from the dryer. The drying air from each nozzle 115 may be substantially maintained in a corresponding zone 111 in the dryer shell by separator plates 125 disposed within the shell and surrounding the drum 130. As shown, the nozzles 115 may be angled upward from the shell 110 (e.g., at an approximately 20° angle) to prevent free water from entering the inlet ports during the cleaning process (as described below).

The drying air passes through apertures or perforations (not shown) in the drum to dry the crumb material in the drum 130 (e.g., by evaporative cooling causing the separation of residual moisture). The size, shape, and arrangement of perforations in the drum may be selected based on the type of material crumb being processed by the rotary drum dryer. For example, the perforations may be sized to prevent (or at least minimize) the crumb from passing through or clogging the perforations. As one example, for a crumb material having a diameter of approximately ½ inch, the rotary drum may be formed from a screen having oblong perforations approximately 0.030 inches wide and approximately 0.75 inches long. The drum may be formed, for example, from wedge-wire, perforated metal, or wire mesh screen selected to provide the desired perforation pattern.

To direct drying air flowing around the outside of the drum into the drum, one or more shield or plates 119 may be secured to the interior surface of the shell (see FIG. 4) and angled toward the outer surface of the drum. Additionally, these plates 119 may extend into contact (or into near contact) with the outer surface of the drum, such that as the drum is rotated, the plates function as scrapers to remove any buildup of polymer material on the outside of the drum, for example, to reduce or prevent blockage of the drum perforations. According to another aspect of the present application, an anti-tack/anti-stick solution may be applied to an exterior surface of the drum 130 to prevent or minimize the buildup of materials on the drum. While many different mechanisms may be utilized to apply the solution, in an exemplary embodiment, the dryer shell 110 is provided with high pressure atomizing nozzles (shown schematically at 127 in FIG. 4) for injecting the solution into the shell and onto the drum. These nozzles 127 may be controlled by an adjustable timer for automatic application of the solution.

One or more exit ports or ducts are provided for the exhaust of drying air from the dryer. While the illustrated embodiment shows first and second exit ducts 121, 122 secured to the end caps 117, 118, in another embodiment, the exit ducts may be disposed on an upper portion of the shell body, which may reduce cross flow of the drying air away from the drum. In one such example, an exit port may be provided for each zone in the shell, to reduce cross-movement of drying air from one zone to another. The exit ports may be provided with internal baffles or valves to allow for adjustment of outflow of the internal air at a controlled rate dependent on the production rate and the type of material being processed. In an exemplary embodiment, the inlet nozzles are configured to supply drying air at a combined flow rate of about 2000 SCFM (e.g., 500 SCFM per nozzle), and the exit ducts are configured to exhaust air at a combined flow rate of about 2400 SCFM (e.g., 1200 SCFM per exit duct), providing for a desired negative pressure within the dryer.

To advance the polymer crumb material through the dryer, the interior wall surface of the rotary drum 130 includes one or more series of circumferentially extending and axially pitched ribs or flights 132, and one or more series of axially extending plates or flippers 133 extending across the flights. In some embodiments, the flights 132 may be continuous, similar to screw threads, while in other embodiments, as shown, the flights may be discontinuous, and circumferentially and/or axially spaced or staggered. As the drum 130 is rotated (e.g., by a motor 139 driving a belt or chain and sprockets), the loose polymer crumb material at the bottom of the drum is caught by flippers 133 and held between the pitched flights 132, which axially advance and rotationally raise the crumb material before dropping the caught crumb material when the flippers reach the upper portion of the dryer. This process is repeated until the polymer crumb material reaches the outlet end of the drum, and is funneled into the discharge chute 113.

To dry the polymer crumb material to a desired moisture content (e.g., between 0.5% and 1%, or about 0.5%), a number of aspects of the dryer 100 may be adjusted, for example, based on the type of polymer material and the size of the crumb particles. The size of the drum screen perforations (which may be dictated, in part, by the size of the particles) may affect the efficiency of the dryer, as larger perforations allow for an increased flow rate of drying air into and through the drum. Based on this drying efficiency, a desired residence time for the product within the dryer (e.g., 3 to 8 minutes, or about 4 minutes) may be established. This residence time may be controlled by selecting a desired pitch of the flights 132 (controlling the rate at which caught material is advanced within the drum) or height of the flippers 133 (controlling the amount of material caught by each flipper). The dryer may be designed to facilitate replacement of the rotary drum, for field installation of a drum having perforation, flight, and flipper characteristics suitable for the particular material drying application. Additionally or alternatively, the rotational speed of the drum may be adjustable, for example, by a variable frequency drive, for end user control the rate at which the material is advanced through the drum. In other arrangements, the various aspects of the rotary drum dryer may be established to accommodate a desired throughput of the material being processed. In one exemplary system, a rotary drum dryer is configured to process up to 400 kg of material per hour, or up to 1600 liters per hour. In another exemplary system, multiple rotary drum dryers (e.g., up to 3) may be installed in series to achieve a desired end moisture in the final product.

According to another aspect of the present application, a rotary drum driver may be provided with additional features to facilitate cleaning. As one example, a rotary drum dryer may be adapted for offline cleaning (e.g., with production halted, for example, for at least two hours), by providing one or more cleaning ports through which pipes may be inserted and securely fastened (e.g., using bolts) to supply high pressure water (e.g., a minimum rating of 6000 psi) into the shell of the rotary dryer. The shell 110 is provided with bottom drain ports 126 provided with valves (not shown) that may be opened to allow for drainage. The discharge chute may be provided with a diverter gate which may be operated to direct water and evacuated materials to a waste box. As water is pumped into the dryer, the drum may be operated (e.g., at its lowest rotational setting) to provide for thorough cleaning of the drum. After the high pressure water pipe is removed, final cleaning may be performed by a hand-held wand inserted into the shell (e.g., through an end of the shell after removing the end cap). After reassembly of the dryer, hot air may be introduced through the inlet nozzles 115 to dry the rotary drum.

Additionally or alternatively, the rotary drum dryer may be provided with features to facilitate online cleaning while processing of the polymer crumb material continues. As one example, the dryer may be provided with at least one air knife (shown schematically at 124 in FIG. 4) that may be provided on the upper interior framework of the shell to direct jets of air against the drum to blow material clogging the drum perforations back into the interior of the drum. The air may be provided from the same source as the air directed to the inlet nozzles 115 and may be consistent in temperature with the air supplied by the inlet nozzle with which the air knives are axially aligned. Exterior inspection cleaning doors (not shown) may be provided to allow for user inspection of the condition of the dryer interior (e.g., the buildup of polymer material within the dryer).

Still other features may be provided. For example, the rotary drum dryer may be provided with a snuffer system, by which a smoke detector or other fire detector is associated with a control system for supplying steam and/or fire water through supply ports (not shown) in the dryer shell.

While various inventive aspects, concepts and features of the inventions may be described and illustrated herein as embodied in combination in the exemplary embodiments, these various aspects, concepts and features may be used in many alternative embodiments, either individually or in various combinations and sub-combinations thereof. Unless expressly excluded herein all such combinations and sub-combinations are intended to be within the scope of the present inventions. Still further, while various alternative embodiments as to the various aspects, concepts and features of the inventions—such as alternative materials, structures, configurations, methods, circuits, devices and components, software, hardware, control logic, alternatives as to form, fit and function, and so on—may be described herein, such descriptions are not intended to be a complete or exhaustive list of available alternative embodiments, whether presently known or later developed. Those skilled in the art may readily adopt one or more of the inventive aspects, concepts or features into additional embodiments and uses within the scope of the present inventions even if such embodiments are not expressly disclosed herein. Additionally, even though some features, concepts or aspects of the inventions may be described herein as being a preferred arrangement or method, such description is not intended to suggest that such feature is required or necessary unless expressly so stated. Still further, exemplary or representative values and ranges may be included to assist in understanding the present disclosure, however, such values and ranges are not to be construed in a limiting sense and are intended to be critical values or ranges only if so expressly stated. Parameters identified as "approximate" or "about" a specified value are intended to include both the specified value and values within 10% of the specified value, unless expressly stated otherwise. Further, it is to be understood that the drawings accompanying the present application may, but need not, be to scale, and therefore may be understood as teaching various ratios and proportions evident in the drawings. Moreover, while various aspects, features and concepts may be expressly identified herein as being inventive or forming part of an invention, such identification is not intended to be exclusive, but rather there may be inventive aspects, concepts and features that are fully described herein without being expressly identified as such or as part of a specific invention, the inventions instead being set forth in the appended claims. Descriptions of exemplary methods or processes are not limited to inclusion of all steps as being required in all cases, nor is the order that the steps are presented to be construed as required or necessary unless expressly so stated. Moreover, while various aspects, features and concepts may be expressly identified herein as being inventive or forming part of an invention, such identification is not intended to be exclusive, but rather there may be inventive aspects, concepts and features that are fully described herein without being expressly identified as such or as part of a specific invention, the inventions instead being set forth in the appended claims. Descriptions of exemplary methods or processes are not limited to inclusion of all steps as being required in all cases, nor is the order that the steps are presented to be construed as required or necessary unless expressly so stated.

The inventive aspects have been described with reference to the exemplary embodiments. Modification and alterations will occur to others upon a reading and understanding of this specification. It is intended to include all such modifications and alterations insofar as they come within the scope of the appended claims or the equivalents thereof.

We claim:

1. A rotary drum dryer comprising:

a shell;

an apertured rotary drum having a longitudinal axis and disposed within the shell and positioned to define a plenum between an interior surface of the shell and an exterior surface of the rotary drum, the plenum being divided into a plurality of zones by at least one separator plate disposed in the shell perpendicular to the longitudinal axis and extending from the rotary drum to the shell;

a plurality of drying air inlet nozzles disposed along the shell, each of the plurality of drying air inlet nozzles being positioned to direct drying air into a corresponding one of the plurality of zones; and at least one elongated plate secured to the interior surface of the shell and extending to the exterior surface of the drum, wherein the at least one elongated plate has an end portion that extends into contact with the rotary drum, such that the end portion scrapes process material from the exterior surface of the rotary drum when the rotary drum is rotated.

2. The rotary drum dryer of claim 1, wherein the shell is externally sealed and insulated.

3. The rotary drum dryer of claim 1, wherein each of the plurality of nozzles is positioned to direct drying air into a lower portion of the corresponding one of the plurality of zones.

4. The rotary drum dryer of claim 1, wherein each of the plurality of nozzles is inclined from a lower portion of the shell.

5. The rotary drum dryer of claim 1, wherein each of the plurality of nozzles is inclined from a lower portion of the shell at an angle of approximately 20°.

6. The rotary drum dryer of claim 1, wherein the at least one elongated plate is angled to direct drying air circling the rotary drum into the rotary drum.

7. The rotary drum dryer of claim 1, further comprising at least one exit port disposed on the shell for exhausting drying air supplied through the plurality of inlet nozzles.

8. The rotary drum dryer of claim 1, further comprising at least one atomizing nozzle disposed on the shell and arranged to supply an anti-tack/anti-stick solution onto the rotary drum.

9. The rotary drum dryer of claim 1, further comprising at least one air knife disposed on the shell and arranged to direct a jet of air against the rotary drum to blow material clogging the drum perforations into the interior of the rotary drum.

10. The rotary drum dryer of claim 1, further comprising a motor assembly operatively connected to the rotary drum for rotating the rotary drum, the motor assembly including a variable frequency drive allowing for adjustment of the rotational speed of the rotary drum.

11. The rotary drum dryer of claim 1, wherein the rotary drum includes a series of circumferentially extending and axially pitched ribs and a series of axially extending plates extending across the ribs for catching and axially advancing a crumb material in the rotary drum.

12. A method of drying a crumb material, the method comprising:

feeding a crumb material into an apertured rotary drum of a rotary drum dryer, the apertured rotary drum having a longitudinal axis;

rotating the rotary drum to axially advance the crumb material through the rotary drum dryer toward a discharge chute; and supplying drying air through a plurality of drying air inlet nozzles disposed along a shell of the rotary drum dryer and into a corresponding plurality of zones in a plenum disposed between an interior surface of the shell and an exterior surface of the rotary drum, the plurality of zones being separated from each other by at least one separator plate disposed in the shell perpendicular to the longitudinal axis and extending from the rotary drum to the shell;

wherein the rotary drum dryer includes at least one elongated plate secured to the interior surface of the shell and extending to the exterior surface of the drum, wherein the at least one elongated plate has an end portion that extends into contact with the rotary drum, such that the end portion scrapes process material from the exterior surface of the rotary drum when the rotary drum is rotated.

13. The method of claim 12, wherein supplying drying air through the plurality of drying air inlet nozzles comprises directing the drying air into the lower portions of the corresponding ones of the plurality of zones.

14. The method of claim 12, further comprising directing drying air circling the rotary drum into the rotary drum using an air shield attached to the interior surface of the shell extending toward the exterior surface of the rotary drum.

15. The method of claim 12, further comprising exhausting drying air through at least one exit port disposed on the shell.

16. The method of claim 12, further comprising supplying an anti-tack/anti-stick solution onto the rotary drum while the rotary drum is rotated to axially advance the crumb material through the rotary drum dryer toward the discharge chute.

17. The method of claim 12, further comprising directing a jet of air against the rotary drum to blow material clogging the drum perforations into the interior of the rotary drum while the rotary drum is rotated to axially advance the crumb material through the rotary drum dryer toward the discharge chute.

18. The method of claim 12, further comprising adjusting the rotational speed of the rotary drum to adjust the residence time of the crumb material in the rotary drum dryer.

19. The method of claim 12, wherein supplying drying air through the plurality of drying air inlet nozzles comprises supplying hot drying air through at least a first drying air inlet nozzle and supplying cool drying air through at least a second drying air inlet nozzle.

* * * * *